US005253408A

United States Patent [19]

Wright

[11] Patent Number: 5,253,408

[45] Date of Patent: Oct. 19, 1993

[54] EXTRACTION TOOL

[76] Inventor: William C. Wright, 1279 Briarwood Rd., Atlanta, Ga. 30219

[21] Appl. No.: 923,823

[22] Filed: Aug. 3, 1992

[51] Int. Cl.[5] ..... B25B 27/14

[52] U.S. Cl. ..... 29/280; 294/11

[58] Field of Search ..... 294/11, 22, 19.1; 29/268, 280, 235, 237, 764, 278, 283

[56] References Cited

U.S. PATENT DOCUMENTS

| | | | |
|---|---|---|---|
| 1,284,323 | 11/1918 | Hansen | 294/11 |
| 2,127,947 | 8/1938 | Weiss | 294/11 |
| 2,326,676 | 8/1943 | Peters | 294/11 |
| 4,125,938 | 11/1978 | Clark | 29/268 |
| 4,202,088 | 5/1980 | Hansen | 29/280 |
| 4,757,588 | 7/1988 | Churchich | 29/268 |

*Primary Examiner*—Robert C. Watson
*Attorney, Agent, or Firm*—Harry I. Leon

[57] ABSTRACT

An extraction tool for reaching into small passageways such as are found in modern automobile engine compartments to aid in the removal of spark plug boots, fuel injector nozzles, PVC valves and the like. The tool comprises an elongated tubular sleeve having an ellipsoidal transverse cross-section and a pair of juxtaposed, lefthanded and righthanded gripping members. Each gripping member includes an elongated rod, a jaw and a handle, which together comprise a single unitary piece. The rods, which are rotatable, are largely disposed within the sleeve while the jaws and handles are situated outside the sleeve and proximate with first and second ends thereof, respectively. In each gripping member, the jaw extends perpendicularly from the rod and is curved towards the other jaw, the inner surface of each jaw lying along an imaginary arc similar to the arc along which the inner surface of the other jaw lies. A torsion spring connected to the handles is employed to bias the handles so that they are normally oriented perpendicularly to each other. To remove an object, a mechanic first slides the open jaws of the tool along the sides of the object. Once the jaws have traversed the full length of the object and are positioned just past its distal edge, he rotates the handles together, closing the jaws, and pulls the object towards himself. In the case of a spark plug boot, a mechanic using this tool can remove the boot without putting strain on the ignition wire.

10 Claims, 3 Drawing Sheets

EXTRACTION TOOL

BACKGROUND OF THE INVENTION

Present day automobile engines are housed in very crowded engine compartments. With such engine compartments, even routine service on engine components is difficult. For example, to replace a spark plug, a mechanic must get a suitable tool, such as a socket wrench with extensions, past a veritable maze of accessories, cables, tubes, and hoses before he can secure the wrench about the plug. First, however, he must remove a boot supporting the ignition wire for the plug. This removal must be accomplished in spite of the fact there is scarcely room, close to the boot, for him to get his hand around the ignition wire. An obvious approach, that of pulling on the wire, is impracticable because such an approach would likely cause damage to the electrical connection at the boot, requiring replacement of the ignition wire.

There has been considerable interest in developing a tool for removing boots from spark plugs. Clark, U.S. Pat. No. 4,125,938, issued Nov. 21, 1978, discloses such a tool which can be fitted over a spark plug boot and which has jaws with lip-like protrusions for engaging the end of the boot directed towards the base of the spark plug. Opening like a scissor, the handles of Clark's tool extend laterally a substantial distance while the open jaws of the tool are being slid over the boot. Uncluttered space located perpendicularly to the centerline of the tool must be provided. The lateral extension of this required space is of the same order of magnitude as the length of the tool, limiting its usefulness. Clark's tool is best suited to those situations in which the spark plug boot is only a relatively short distance beyond the reach of the mechanic's unaided hand.

Hansen, U.S. Pat. No. 4,202,088, issued May 13, 1980, discloses a spark plug boot puller with no moving parts and hence no scissor-type action. To use Hansen's tool, a mechanic slips a shoulder of its L-shaped member beneath one side of the end of the boot directed towards the base of the spark plug and then pulls the boot from the plug. At most only about one-half of said end of the boot actually contacts the shoulder. Moreover, to use this tool, one must have a substantial amount of uncluttered space. This uncluttered space must not only extend the length of the boot but also have a transverse width greater than that of the puller. In addition, the mechanic must have room in which he can exert a side force pushing the shoulder laterally and under the boot. Otherwise, the tool, which lacks any means for providing this necessary side force, could not be properly positioned beneath the boot.

Simmons, U.S. Pat. No. 4,425,697, issued Jan. 17, 1984, discloses a spark plug boot remover having an inwardly extending lip which is similar to the shoulder of the L-shaped member in Hansen's tool. Both this lip and Hansen's shoulder must be slipped beneath the end of the boot facing towards the base of the spark plug. Simmon's tool has essentially the same space and side force requirements for placement of the inwardly extending lip beneath said end of the boot as does the placement of the shoulder in Hansen's tool. Simmon's tool differs from Hansen's tool in that the former also includes means for pulling the boot off of the spark plug by pushing downwardly on a lever which in turn pushes an arm of the tool against the head of the engine forcing the boot puller away from the head of the engine, thereby facilitating removal of the boot.

SUMMARY OF THE INVENTION

An object of the present invention is to provide a narrow, elongated tool which can be slipped under an end of a spark plug boot and which can then be used to pull the boot directly off of the spark plug, even though the hands of the tool's user are kept at a substantial distance from the boot while it is being removed.

A further object of the present invention is to provide a tool which can be used to pull on an end of a component mounted in a deep well or other recess where the end faces inwardly towards the recess and in a direction opposite to that of the user and where there is little clearance between the component and the walls of the recess.

A still further object of the present invention is to provide a tool for removing a component in which access of the tool to an end of the component facing in a direction opposite to that of the user requires a space along the sides of the component which is only about 1/16 inch greater than the radius of the largest transverse cross-section of the component, the size of the required space being independent of the depth to which the tool must reach.

A still further object of the present invention is to provide a tool for removing a component, such as a spark plug boot, fuel injector or PVC valve, in which pressure must be applied to an end of the component facing in a direction opposite to that of the user, the tool applying pressure along nearly the entire periphery of said end and pushing outwardly against it in a direction parallel to the longitudinal centerline of the component as the user pulls on the tool, thereby minimizing stress on the component during its extraction.

The extraction tool according to the present invention comprises a tubular sleeve having a transverse cross-section just large enough to accommodate two elongated rods which are disposed side by side within the sleeve but which are, at the same time, rotatable about their respective longitudinal axes. Extending from distal ends of the sleeve, each rod is disposed between a jaw and a handle, which together comprise a gripping member. Preferably, the rod, the jaw and the handle form a single, unitary piece which can be fabricated by bending a cylindrical rod formed of hardened steel or the like.

In each gripping member, the jaw extends perpendicularly from the rod and is curved, the inner surfaces of the two jaws being disposed along imaginary arcs with similar radii of curvature. The jaws of the two gripping members, in the assembled tool, are curved towards each other, forming lefthanded and righthanded jaws.

Distal from the jaw, each gripping member includes a handle. The handle comprises a loop with an opening in which a person can comfortably insert at least one finger and then pull on the handle using that finger. Alternately, the handle has a smoothly curved structure against which a user can pull with one or more fingers.

The handle and the jaw in each gripping member extend laterally from the longitudinal axis of the rod into a segment of space bounded by two imaginary planes whose intersection coincides with the longitudinal axis, the planes being disposed at an acute angle with respect to each other.

A torsion spring connected to the handles and to the sleeve is employed to urge the handles apart and to keep the jaws open. The jaws can be closed by pressing the handles, which are otherwise disposed generally perpendicularly to each other, together. In the preferred embodiment, the tips of the jaws nearly touch when the handles meet.

To remove an object, a mechanic first slides the open jaws of the tool along the sides of the object. Once the jaws have traversed the full length of the object and are positioned just past the edge thereof which is disposed furthest away from the user, he closes the jaws by rotating the two handles until points thereon which are most distal from the rods are brought into contact or close proximity with each other. In an extraction tool properly sized for the application at hand, the jaws will then fit snugly about the base of the object to be removed. To complete the removal, the user needs only to insert one or more fingers of one of his hands through both handles simultaneously and, employing that hand alone, pull the object away from its mounting.

In a situation in which a spark plug boot is to be removed, the tool is used as follows: the open jaws of the tool are placed on the stem of the spark plug just under the boot. The user then closes the jaws by rotating the handles together, inserts at least one finger through both handles and finally pulls the boot off of the plug. The removal of the boot is accomplished from a distance without putting any strain on the ignition wire supported by the boot.

Where a fuel injector is to be removed, the jaws of a heavy duty version of the extraction tool are placed on the underside of the injector proximate with to its sealing O-ring. The jaws are then closed. Pulling with the handles, the mechanic removes the injector from its socket. This removal is achieved, with the tool according to the present invention, without putting any strain on plastic housings containing controls for the injector or otherwise damaging it.

In an alternate embodiment, the tool further comprises a third rod juxtaposed beside the two rotatable rods in a sleeve of generally triangular transverse cross-section. The third rod, which is employed as a pusher, has at one of its ends a rounded, enlarged tip. As the tool is being used, this enlarged tip is maintained in contact with a stationary component, such as an engine head, proximate with the component being removed. Distal from the enlarged tip, a knob is affixed to the pusher rod. The knob is located near the handles of the gripping members, so that a mechanic can, using only one hand, simultaneously pull the handles with his fingers and push on the knob with his thumb.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENTS

Figure 1:
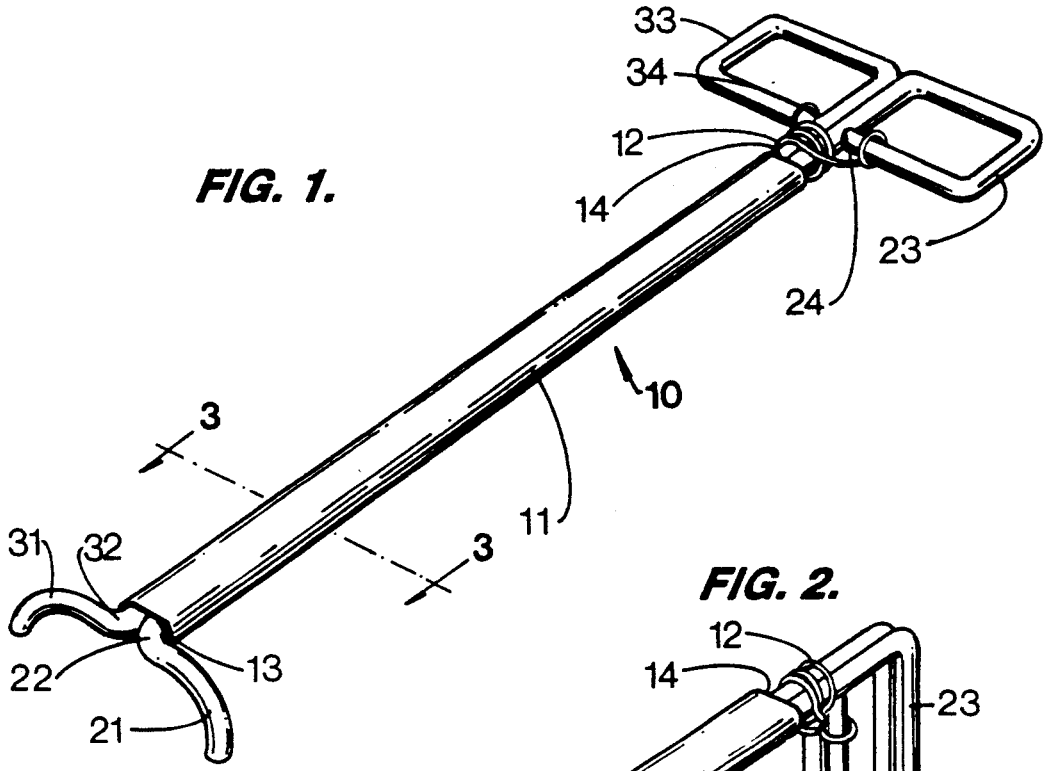
FIG. 1 is a perspective view of the extraction tool according to the present invention showing the tool with its jaws open.

Referring now to the drawings, an extraction tool, indicated generally by the reference numeral 10, comprises a pair of righthanded and lefthanded gripping members having rods 20, 30, respectively. The tool 10 also comprises means, including a sleeve 11, for retaining the rods in juxtaposed position while allowing each of them to be rotated about its longitudinal axis. In the preferred embodiment illustrated in FIGS. 1 through 6, the rods 20, 30 are circular in transverse cross-section and are received within the sleeve 11 whose inner walls define a void which is ellipsoidal in transverse cross-section.

Extending perpendicularly to the longitudinal axes of the rods 20, 30 are jaws 21, 31, respectively. The jaws 21, 31, which are curved towards each other in the assembled tool 10, provide means for pushing against a side of a component directed away from a user during the removal of the component.

Figure 2:
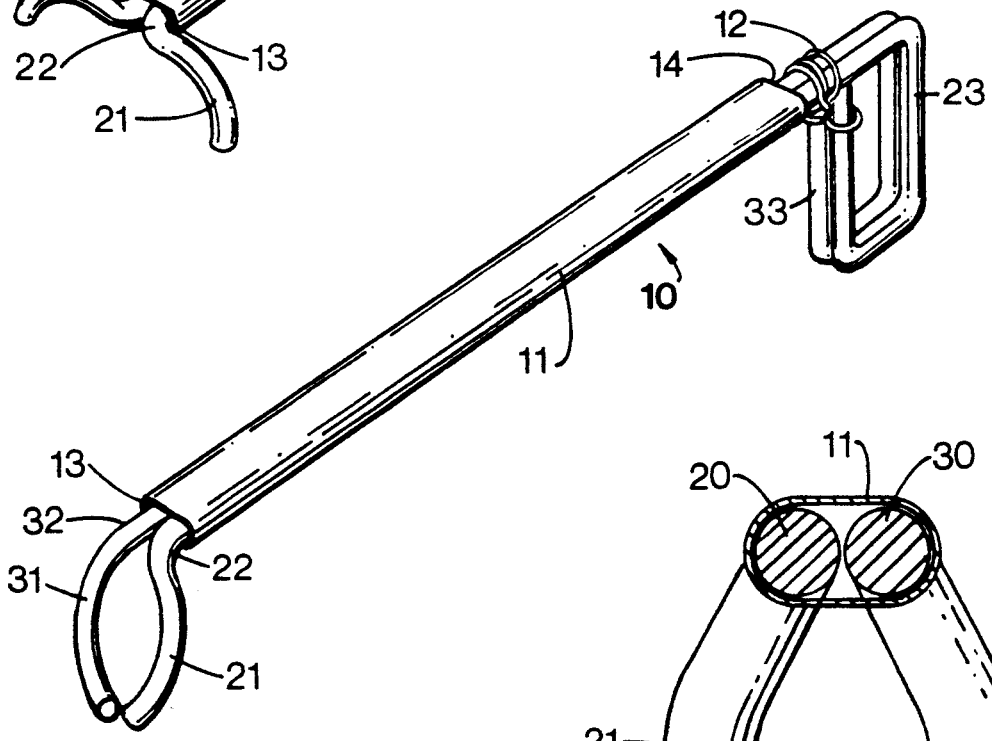
FIG. 2 is a perspective view of the extraction tool according to the present invention showing the tool with its jaws closed.
Figure 3:
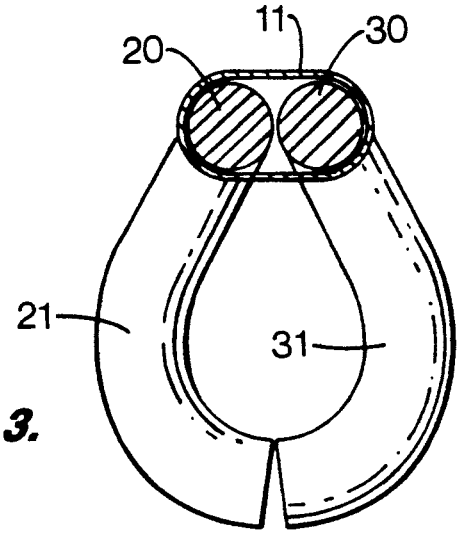
FIG. 3 is a cross-section 3—3, on an enlarged scale, of the tool according to FIG. 1.

A handle 23, 33 also extends laterally from each of the rods 21, 31 and in a substantially the same direction as does the respective jaw 21, 31. Located at ends of the rods 20, 30 distal from the jaws 21, 31, the handles 23, 33, nevertheless, control the movement of the jaws. When the two handles 23, 33 are brought together, the jaws 21, 31 close (FIG. 2). When the two handles 23, 33 lie in virtually the same plane, the jaws 21, 31 are fully open (FIG. 1). In applications in which there is little clearance between the component to be removed and its immediate surroundings, the handles 23, 33 are held so that they disposed generally perpendicularly to each other. The jaws 21, 31 are then half-open. Half-open jaws 21, 31 allow a user to skim the jaws across the outer sides of the component, a process which can be accomplished using the tool 10 even when the unclutered space along the sides of the component is only about 1/16 inch greater than the radius of the largest transverse cross-section of the component.

Disposed past a first end 14 of the sleeve 11, each handle 23, 33 preferably defines a closed structure which abuts the rod 21, 31 at juncture points 24, 34, respectively, and has an opening large enough for one or more fingers to be inserted therein. Alternately, each handle defines a structure (not shown) which is not closed but against which one can pull with one or more fingers.

Means for urging the handles 23, 33 apart includes a resilient torsion spring 12 through which the rods 20, 30 extend longitudinally, each end of the spring being connected to one of the handles. The spring 12 is readily overcome by finger pressure bringing the handles together.

The jaws 21, 31 are kept laterally aligned with each other by a torsion spring 12 and by bends 22, 32 formed between the jaws and the rods 20, 30. The spring 12, which is connected to the rods 21, 31 between the handles 24, 34 and the first end 14, prevents the rods from bringing either of the handles closer to the sleeve 11; the bends 22, 32, on the other hand, which ride against a second end 13 of the sleeve, limit the travel of the rods in the opposite direction.

The preferred dimensions of the tool 10 vary with its intended use. For light duty work such as a spark plug boot removal, the gripping members of the tool 10 are preferably fabricated from hardened steel rods or the like having a diameter in the range of 1/16 inch to 3/32 inch. The sleeve 11 is preferably fabricated from thin wall tubing having an inner diameter in the range of ¼ inch to 5/16 inch, respectively. The tubing is shaped, by flattening it or otherwise, into a structure for receiving the rods 20, 30. This structure, which is preferably of ellipsoidal transverse cross-section, has sufficient clearance between its walls and the rods to allow the rods to be rotated about their respective longitudinal axes. The overall length of the tool 10 can be as short as a few inches for work in close quarters to as long as two or more feet.

For heavy duty work such as fuel injector removal, the gripping members of the tool 10 are preferably fabricated, by bending, from hardened steel rods or the like having a diameter of about ¼ inch. The sleeve 11 is preferably fabricated from thin wall tubing having an inner diameter of about ½ inch. As in the model of the tool 10 designed for light duty work, the tubing must be shaped into a sleeve 11 with sufficient clearance between its walls and the rods 20, 30 to allow them to be rotated about their respective longitudinal axes when they are held, by the sleeve, in juxtaposition with each other. The overall length of the heavy duty model of the tool 10 is about one foot.

Figure 4:
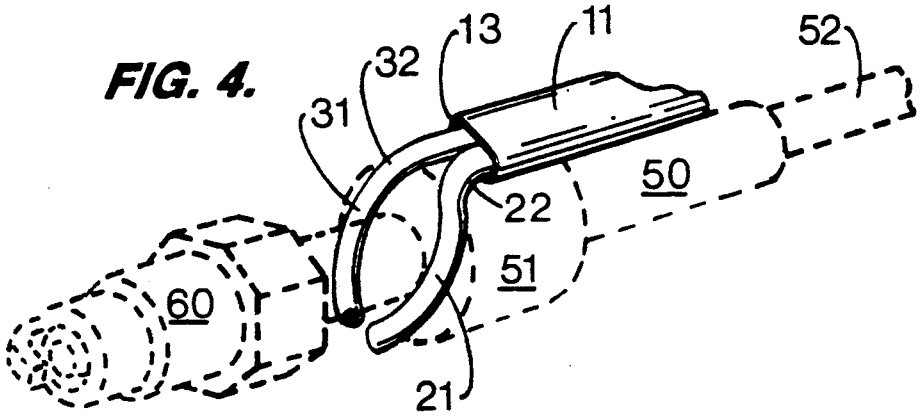
FIG. 4 is a fragmentary side elevational view of the tool according to FIG. 1, the jaws of the tool gripping the boot of an spark plug ignition wire prior to removal of the boot from the spark plug, the plug, ignition wire, and boot being illustrated in dashed lines.
Figure 5:
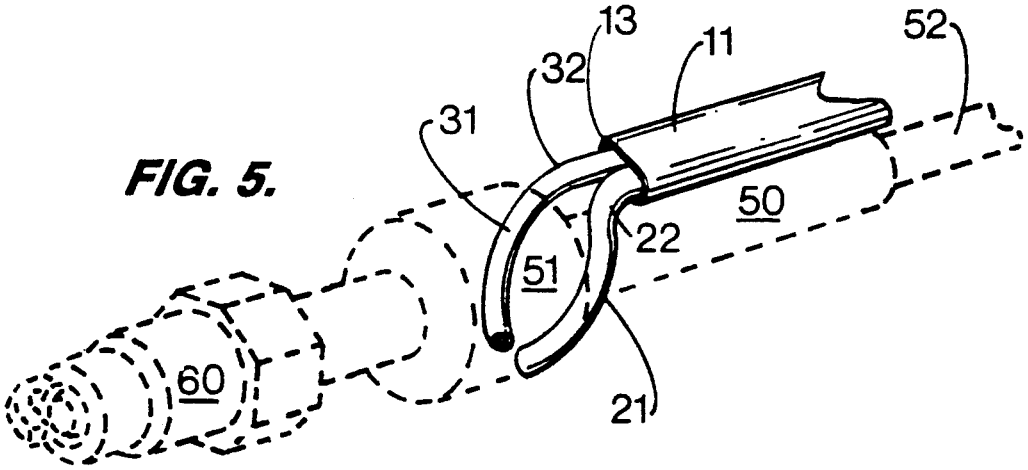
FIG. 5 is a fragmentary side elevational view of the tool according to FIG. 1, the jaws of the tool gripping the boot of an spark plug ignition wire prior to installation of the boot on the spark plug, the plug, ignition wire, and boot being illustrated in dashed lines.
Figure 6:
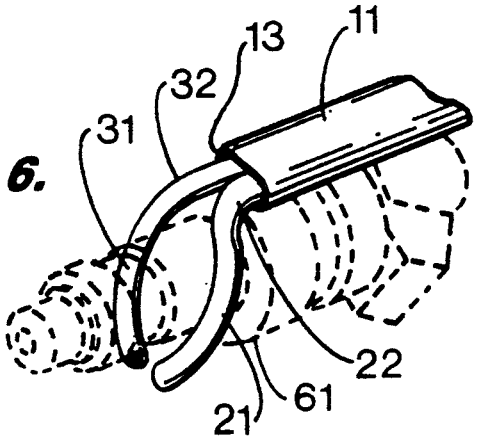
FIG. 6 is a fragmentary side elevational view of the tool according to FIG. 1, the jaws of the tool gripping a fuel injector prior to its removal from an internal combustion engine (not shown); the fuel injector being illustrated in dashed lines.

The operation of the tool 10 is simple, especially when it is employed for spark plug boot removal and installation. After inserting the elongated tool 10 into any suitable opening between engine components, a user sets the jaws 21, 31, closing them around the neck of a spark plug 60 and under the base 51 of the spark plug boot (FIG. 4). He then pulls on the handles 23, 33 to dislodge the boot. To replace the boot on the spark plug 60, on the other hand, the user grips an upper, narrow part 50 of the boot between the jaws 21, 31 and pushes against the thick base 51 of the boot (FIG. 5). In neither the removal of the spark plug boot nor its installation is any stress placed on the ignition wire 52.

To remove a fuel injector 61, the jaws 21, 31 of a heavy duty model of the tool 10 are positioned so that they surround a narrow section of the injector next to the engine (not shown). With the handles 23, 33 rotated together as far as possible, thereby forcing the jaws 21, 31 to grip the injector, the user then inserts a finger, usually his index finger, into the handles and pulls them, freeing the injector from its mounting.

Figure 7:
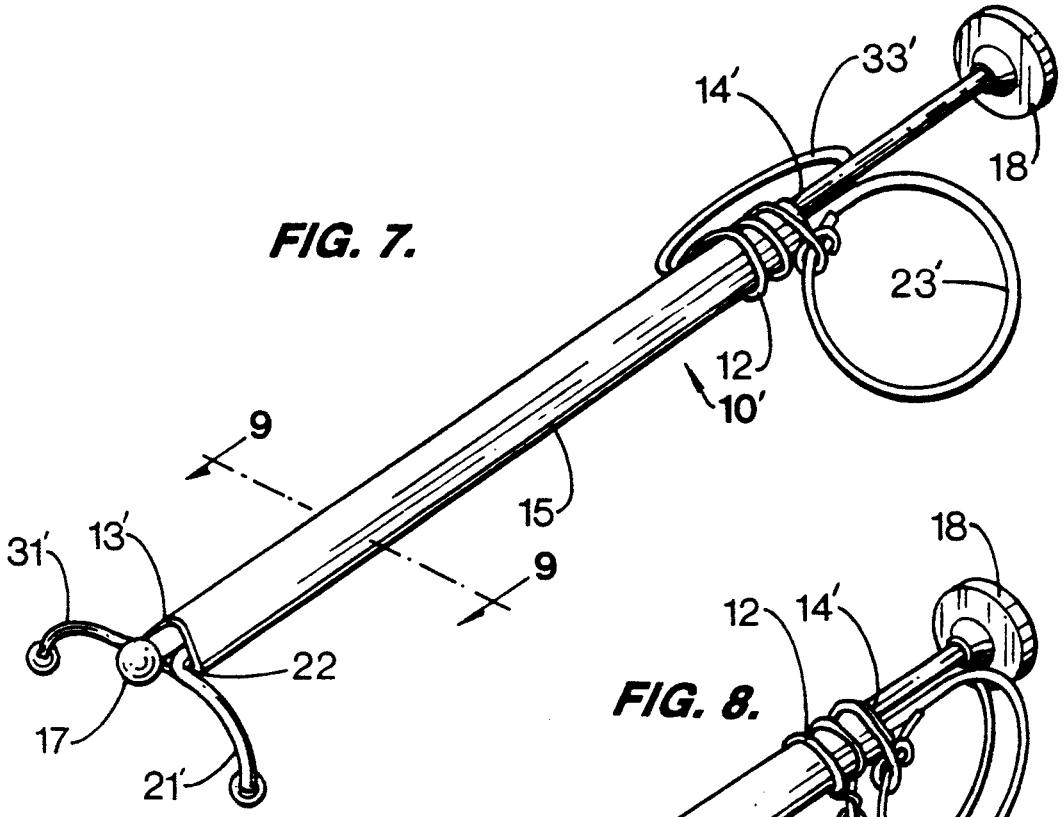
FIG. 7 is a perspective view of an alternate embodiment of the extraction tool according to the present invention showing the tool with its jaws open.
Figure 8:
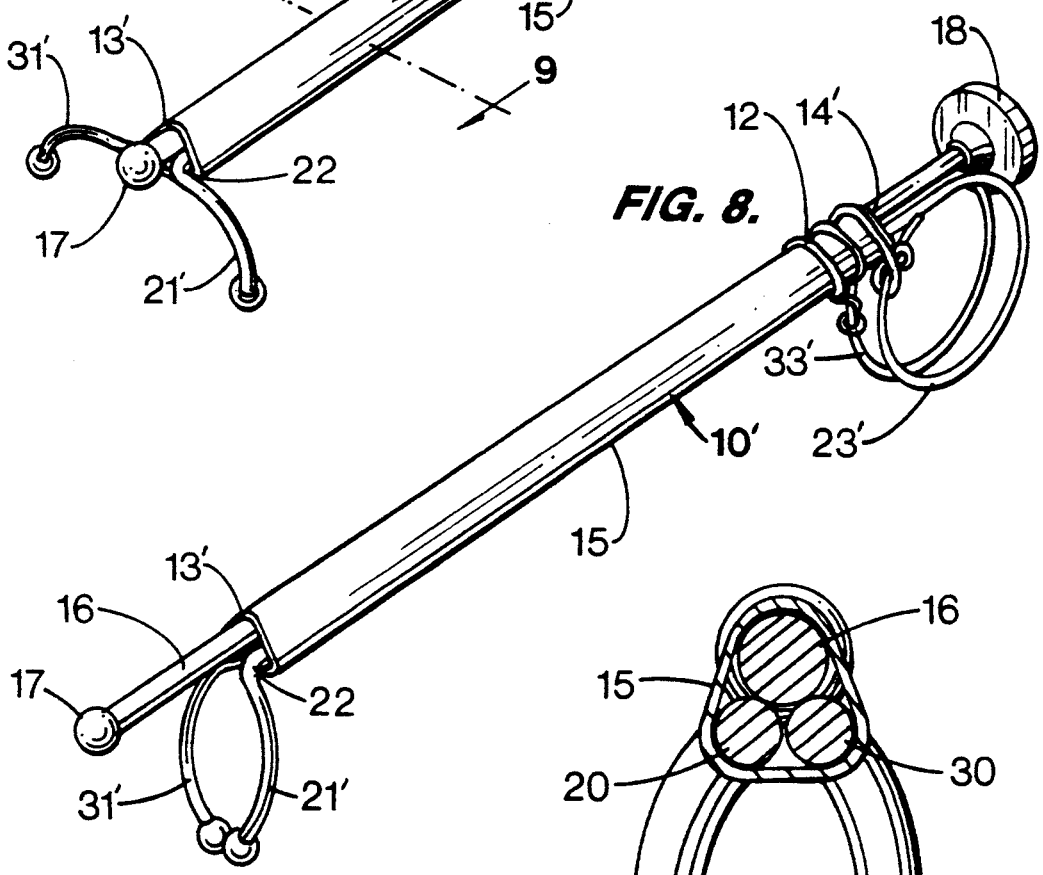
FIG. 8 is a perspective view of an alternate embodiment of the extraction tool according to the present invention showing the tool with its jaws closed and its pusher rod extended.
Figure 9:
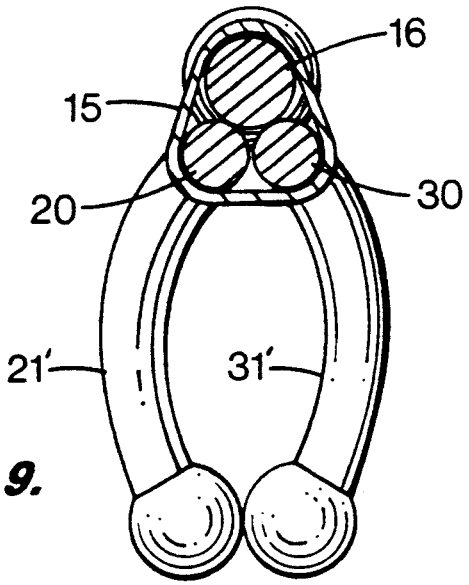
FIG. 9 is a cross-section 9—9, on an enlarged scale, of the tool according to FIG. 7.

In an alternate embodiment illustrated in FIGS. 7 through 9, a tool 10' further comprises a pusher rod 16 juxtaposed beside rods 20, 30 in a sleeve 15 having ends 13', 14' which are of generally triangular transverse cross-section. An enlarged rounded tip 17 defines a terminal end of the rod 16. The enlarged tip 17, which is located distal from the handles 23', 33', is employed in part to stabilize the position of the tool 10' relative to that of a stationary component (not shown), such as an engine head, located next to the component being removed. The enlarged tip 17, together with a rest 18 attached to the opposite end of the rod 16, also prevents the rod 16 from sliding out of the sleeve 15. The rest 18 is positioned sufficiently close to the handles 23', 33', so that a person, using only one hand, can hold the handles together with his fingers and thumb and simultaneously push on the rest.

To remove a component using the tool 10', the user first sets the jaws 21', 31' about the base of the component and next places the enlarged tip 17 of the pusher rod 16 in contact with a proximate stationary engine component. He then rotates the handles 23', 33' together, closing the jaws, inserts one or two fingers into the handles, and finally, while pressing the rod 16 against the stationary component with his thumb, pulls the handles towards the knob. Using the tool 10' following this technique, the user can free the component from its mounting without his having to move his hand away from the component, saving the hand from potential injury.

For typical applications involving spark plug boot removal, the rods 20, 30 and the pusher rod 16 of a tool 10' are preferably fabricated from hardened steel rods or the like having diameters of 3/32 inch and of ⅛ inch, respectively.

It is understood that those skilled in the art may conceive other applications, modifications and/or changes in the invention described above. Any applications, modifications or changes which fall within the purview of the description are intended to be illustrative and not intended to be limitative. The scope of the invention is limited only by the scope of the claims appended hereto.

I claim:

1. An extraction tool, comprising:

(a) two gripping members, each gripping member including an elongated rod, a jaw, and a handle, the jaw extending perpendicularly from the elongated rod, the handle protruding laterally from the elongated rod in substantially the same direction as the jaw; and (b) a sleeve for retaining the elongated rods in side by side position longitudinally while allowing each of the elongated rods to be rotated a fraction of a turn about its longitudinal axis, the jaws having concave inner surfaces which face generally toward each other when the handles have been moved as far as possible together, the sleeve extending longitudinally from points proximate with each of the handles to points proximate with each of the jaws.

2. An extraction tool, comprising:

(a) two gripping members, each gripping member including an elongated rod, a jaw, and a handle, the jaw extending perpendicularly from the rod, the handle protruding laterally from the rod in substantially the same direction as the jaw;

(b) means for retaining the rods in juxtaposed position longitudinally while allowing each of the rods to be rotated a fraction of a turn about its longitudinal axis; each gripping member, when the elongated rods are retained in juxtaposed position, defining a side of the tool, the handle and the jaw in the gripping member being disposed generally on the same side of the tool;

(c) means, including the handles, for moving both of the jaws simultaneously, the jaws having concave inner surfaces which face generally toward each other when the handles have been moved as far as possible together; and (d) means for maintaining the jaws in alignment with each other, tips of the jaws distal from the rods being disposed in close proximity to each other when the jaws are closed.

3. The extraction tool according to claim 2 wherein each handle further comprises a closed loop, the openings of the handles being generally aligned with each other when the handles are moved as far as possible together.

4. The extraction tool according to claim 2 which further comprises spring biasing means for urging the handles apart, each of the rods rotating about its longitudinal axis once the handles are released until the jaws and handles assume positions in which they are, respectively, partially open and disposed perpendicularly with respect to each other.

5. The extraction tool according to claim 2 wherein each of the rods can rotate at least one-eighth of a turn about its longitudinal axis.

6. The extraction tool according to claim 2 wherein the jaw, the rod and the handle of each gripping member comprise a single, unitary member.

7. An extraction tool, comprising:

(a) two gripping members, each gripping member including an elongated rod, a jaw, and a handle, the jaw extending perpendicularly from the elongated rod, the handle protruding laterally from the elongated rod in substantially the same direction as the jaw; and (b) a sleeve for retaining the elongated rods in juxtaposed position longitudinally while allowing each of the elongated rods to be rotated a fraction of a turn about its longitudinal axis, the jaws having concave inner surfaces which face generally toward each other when the handles have been moved as far as possible together; the gripping members being disposed on opposite sides of an imaginary plane which extends longitudinally along the sleeve and passes through both ends of the sleeve.

8. The extraction tool according to claim 7 which further comprises spring biasing means for urging the handles apart, each of the rods rotating about its longitudinal axis once the handles are released until the jaws and handles assume positions in which they are, respectively, partially open and disposed perpendicularly with respect to each other.

9. The extraction tool according to claim 7 wherein each of the rods can rotate at least one-eighth of a turn about its longitudinal axis.

10. The extraction tool according to claim 7 wherein the jaw, the rod and the handle of each gripping member comprise a single, unitary member.

* * * * *